US008733009B2

(12) United States Patent
Ricks

(10) Patent No.: US 8,733,009 B2
(45) Date of Patent: May 27, 2014

(54) MAGAZINE CUTOFF

(75) Inventor: Jonathan Ricks, Cecilia, KY (US)

(73) Assignee: RA Brands, L.L.C., Madison, NC (US)

( * ) Notice: Subject to any disclaimer, the term of this patent is extended or adjusted under 35 U.S.C. 154(b) by 195 days.

(21) Appl. No.: 13/345,256

(22) Filed: Jan. 6, 2012

(65) Prior Publication Data

US 2013/0174456 A1 Jul. 11, 2013

(51) Int. Cl.
*F41A 9/18* (2006.01)
*F41A 9/19* (2006.01)

(52) U.S. Cl.
CPC .... *F41A 9/18* (2013.01); *F41A 9/19* (2013.01)
USPC ..... 42/21; 89/136

(58) Field of Classification Search
CPC ..... F41A 9/18; F41A 9/19
USPC ..... 42/17, 21; 89/138
See application file for complete search history.

(56) References Cited

U.S. PATENT DOCUMENTS

| | | | | |
|---|---|---|---|---|
| 1,318,423 | A | 10/1919 | Williams | |
| 1,349,675 | A | 8/1920 | Johnson | |
| 2,418,946 | A | 4/1947 | Loomis | |
| 2,491,218 | A * | 12/1949 | Sefried | 89/138 |
| 2,601,808 | A | 7/1952 | Clarke | |
| 2,765,557 | A * | 10/1956 | Roper | 42/17 |
| 2,861,374 | A | 11/1958 | Hampton | |
| 2,871,603 | A | 2/1959 | Wild | |
| 2,941,449 | A | 6/1960 | Reed | |
| 2,976,637 | A | 3/1961 | Robinson, Jr. | |
| 3,165,849 | A | 1/1965 | Into | |
| 3,255,547 | A | 6/1966 | Gregory, Jr. | |
| 3,368,298 | A | 2/1968 | Browning | |
| 3,397,473 | A | 8/1968 | Browning | |
| 3,507,184 | A | 4/1970 | Prybyla | |
| 3,619,926 | A | 11/1971 | Alday | |
| 3,631,621 | A | 1/1972 | Tito | |
| 3,675,534 | A | 7/1972 | Beretta | |
| 3,680,433 | A | 8/1972 | Tollinger | |
| 3,688,640 | A | 9/1972 | Seecamp | |
| 3,722,123 | A | 3/1973 | Parisi | |
| 3,759,135 | A | 9/1973 | Tollinger | |
| 3,782,022 | A | 1/1974 | Bielfeldt et al. | |

(Continued)

FOREIGN PATENT DOCUMENTS

| | | |
|---|---|---|
| DE | 28445 C | 9/1884 |
| DE | 708197 | 7/1941 |

(Continued)

OTHER PUBLICATIONS

Supplementary European Search Report dated Nov. 27, 2006 for European Patent Application No. 04 80 9407.

(Continued)

*Primary Examiner* — Stephen M Johnson
(74) *Attorney, Agent, or Firm* — Womble Carlyle Sandridge & Rice, LLP

(57) ABSTRACT

A magazine cutoff device for a firearm with a tube-type magazine, such as, e.g., semi-automatic shotgun. The cutoff device may be moveably mounted to accommodate at least two positions, on and off. The user may activate the cutoff, pull the bolt to the rear, eject a chambered shell, and lock the bolt to the rear while retaining any shells in the magazine.

11 Claims, 6 Drawing Sheets

(56) References Cited

U.S. PATENT DOCUMENTS

| | | | |
|---|---|---|---|
| 3,789,730 | A | 2/1974 | Helmes |
| 3,848,510 | A | 11/1974 | Wolpert |
| 3,919,800 | A | 11/1975 | Browning |
| 3,938,271 | A | 2/1976 | Hyytinen |
| 3,996,684 | A | 12/1976 | Bauman et al. |
| 3,996,685 | A | 12/1976 | Bauman et al. |
| 4,135,434 | A | 1/1979 | Hurklemann et al. |
| 4,172,410 | A | 10/1979 | Anderson |
| 4,305,218 | A | 12/1981 | Godsey |
| 4,344,246 | A | 8/1982 | Bauman et al. |
| 4,389,919 | A | 6/1983 | Kast et al. |
| 4,445,292 | A | 5/1984 | Martin |
| 4,454,672 | A | 6/1984 | Timari |
| 4,516,466 | A | 5/1985 | Jennie |
| 4,593,488 | A | 6/1986 | Ruger |
| 4,604,942 | A | 8/1986 | Benelli |
| 4,703,826 | A | 11/1987 | Byron |
| 4,856,217 | A | 8/1989 | Benelli |
| 4,867,039 | A | 9/1989 | Dobbins |
| 4,942,802 | A | 7/1990 | Stoner |
| 5,373,775 | A | 12/1994 | Findlay, Sr. et al. |
| 5,463,828 | A | 11/1995 | Andrejevic |
| 5,551,180 | A | 9/1996 | Findlay et al. |
| 5,682,007 | A | 10/1997 | Dobbins |
| 5,718,073 | A | 2/1998 | Sachse et al. |
| 5,740,516 | A | 4/1998 | Jiranek, II et al. |
| 5,768,815 | A | 6/1998 | Casull |
| 5,771,620 | A | 6/1998 | Crawford et al. |
| 5,806,226 | A | 9/1998 | Norton et al. |
| 5,918,401 | A | 7/1999 | Rowlands |
| 5,987,798 | A | 11/1999 | Ronkainen |
| 6,189,253 | B1 | 2/2001 | Knight et al. |
| 6,345,460 | B2 | 2/2002 | Hashman |
| 6,347,569 | B1 | 2/2002 | Butler |
| 6,393,961 | B1 | 5/2002 | Ockenfuss |
| 6,418,655 | B1 | 7/2002 | Kay |
| 6,427,372 | B1 | 8/2002 | Howard et al. |
| 6,470,616 | B1 | 10/2002 | Clay |
| 6,484,430 | B1 | 11/2002 | Robinson et al. |
| 6,510,778 | B1 | 1/2003 | Irwin |
| 6,536,150 | B2 | 3/2003 | Schweikart |
| 6,564,691 | B2 | 5/2003 | Butler |
| 6,625,917 | B2 | 9/2003 | Murello et al. |
| 6,708,437 | B2 | 3/2004 | Murello |
| 6,732,465 | B2 | 5/2004 | Strayer |
| 6,910,404 | B2 | 6/2005 | Wolff et al. |
| 7,000,345 | B1 | 2/2006 | Kay |
| 7,107,715 | B2 | 9/2006 | Keeney et al. |
| 7,219,461 | B1 | 5/2007 | Keeney et al. |
| 7,331,135 | B2 | 2/2008 | Shimi |
| 7,533,598 | B1 | 5/2009 | Murphy |
| 7,661,219 | B1 | 2/2010 | Knight, Jr. et al. |
| 7,707,923 | B2 | 5/2010 | Gussalli Beretta |
| 7,971,379 | B2 | 7/2011 | Robinson et al. |
| 7,975,595 | B2 | 7/2011 | Robinson et al. |
| 8,079,168 | B2 | 12/2011 | Lesenfants |

FOREIGN PATENT DOCUMENTS

| | | | |
|---|---|---|---|
| EP | 0 860 677 | A2 | 8/1998 |
| EP | 0 860 677 | A3 | 9/1999 |
| EP | 1 345 000 | A1 | 9/2003 |
| WO | WO 2013-103471 | | 7/2013 |

OTHER PUBLICATIONS

International Search Report dated Mar. 18, 2013 for International Patent Application No. PCT/US2012/068417.

Written Opinion dated Mar. 18, 2013 for International Patent Application No. PCT/US2012/068417.

* cited by examiner

MAGAZINE CUTOFF

BACKGROUND OF THE PRESENT DISCLOSURE

1. Field of the Present Disclosure

The present disclosure is directed to a device for blocking the normal action of certain components in an auto-loading firearm, such as, e.g., a shotgun. These components normally function to feed a round from the magazine to the chamber. The device thus prevents the chambering of a new round.

2. Related Art

Safety is the top concern whenever firearms are handled. Safety guidelines state that a round should be chambered only when the user intends to discharge the firearm. When moving, such as, e.g., riding an ATV, crossing a fence, and the like, the chambered round should be cleared.

The empty chamber provides an extra level of protection. Even if the mechanical safety associated with the trigger fails, the firearm cannot discharge because the chamber is empty. There is nothing for the gun to fire.

Clearing the chamber on a firearm with a clip-type magazine is a relatively simple affair. The user simply removes the clip and then pulls back the bolt to eject the round from the chamber.

In a firearm with a tube-type magazine, however, the process is not so simple. For example, in shotguns having tube-type magazines, each round must be manually ejected from the magazine by manually opening and closing the bolt until the magazine is empty. Likewise, reloading requires that each round be inserted individually into the magazine. A hunter who simply wants to cross a fence may have to unload the magazine, locate the ejected rounds, and manually reload the firearm. Some users may view this procedure as a hassle, which may in turn encourage less than ideal safety practices.

Accordingly, there is a need for a mechanism or device for a firearm with a tube magazine to hold the bolt open with an empty chamber while retaining any remaining rounds in the magazine.

SUMMARY OF THE PRESENT DISCLOSURE

The present disclosure meets the foregoing need and holds the bolt open while retaining rounds in the magazine using a magazine cutoff, which results in a significant improvement in ease of use and other advantages apparent from the discussion herein.

Accordingly, in one aspect of the present disclosure a cutoff device for a firearm includes a magazine cutoff configured to be positionable in a plurality of user selectable positions and connected to a fire control of the firearm to control loading of ammunition from a magazine. The magazine cutoff may be configured to locate a carrier in different positions thereby controlling loading of ammunition.

According to another aspect of the present disclosure a firearm includes a tube-type magazine configured to hold at least one shell, a bolt having an open position and a closed position, a carrier configured to transfer a shell from the magazine to engage the bolt, and a magazine cutoff device having a plurality of user selectable positions configured to engage and retain the carrier in a predetermined position.

In yet another aspect of the present disclosure a method for manufacturing a cutoff device for a firearm includes providing a magazine cutoff configured to be positionable in a plurality of user selectable positions and connected to a fire control of the firearm to control loading of ammunition from a magazine, wherein the magazine cutoff is configured to locate a carrier in different positions thereby controlling loading of ammunition.

In another aspect, a method of assembling a firearm includes providing a firing mechanism, the firing mechanism comprising a chamber, providing a tube-type magazine, providing a carrier configured to at least partially transfer a shell from the magazine to the chamber; and providing a magazine cutoff device manufactured according to the method already described in the preceding paragraph.

Additional features, advantages, and aspects of the present disclosure may be set forth or apparent from consideration of the following detailed description, drawings, and claims. Moreover, it is to be understood that both the foregoing summary of the present disclosure and the following detailed description are exemplary and intended to provide further explanation without limiting the scope of the present disclosure as claimed.

BRIEF DESCRIPTION OF THE DRAWINGS

The accompanying drawings, which are included to provide a further understanding of the present disclosure, are incorporated in and constitute a part of this specification, illustrate aspects of the present disclosure and together with the detailed description serve to explain the principles of the present disclosure. No attempt is made to show structural details of the present disclosure in more detail than may be necessary for a fundamental understanding of the present disclosure and the various ways in which it may be practiced. In the drawings:

FIGS. 7C and 7D illustrates additional latch release functionality of FIG. 7B, configured according to principles of the disclosure.

DETAILED DESCRIPTION OF THE PRESENT DISCLOSURE

Figure 1:
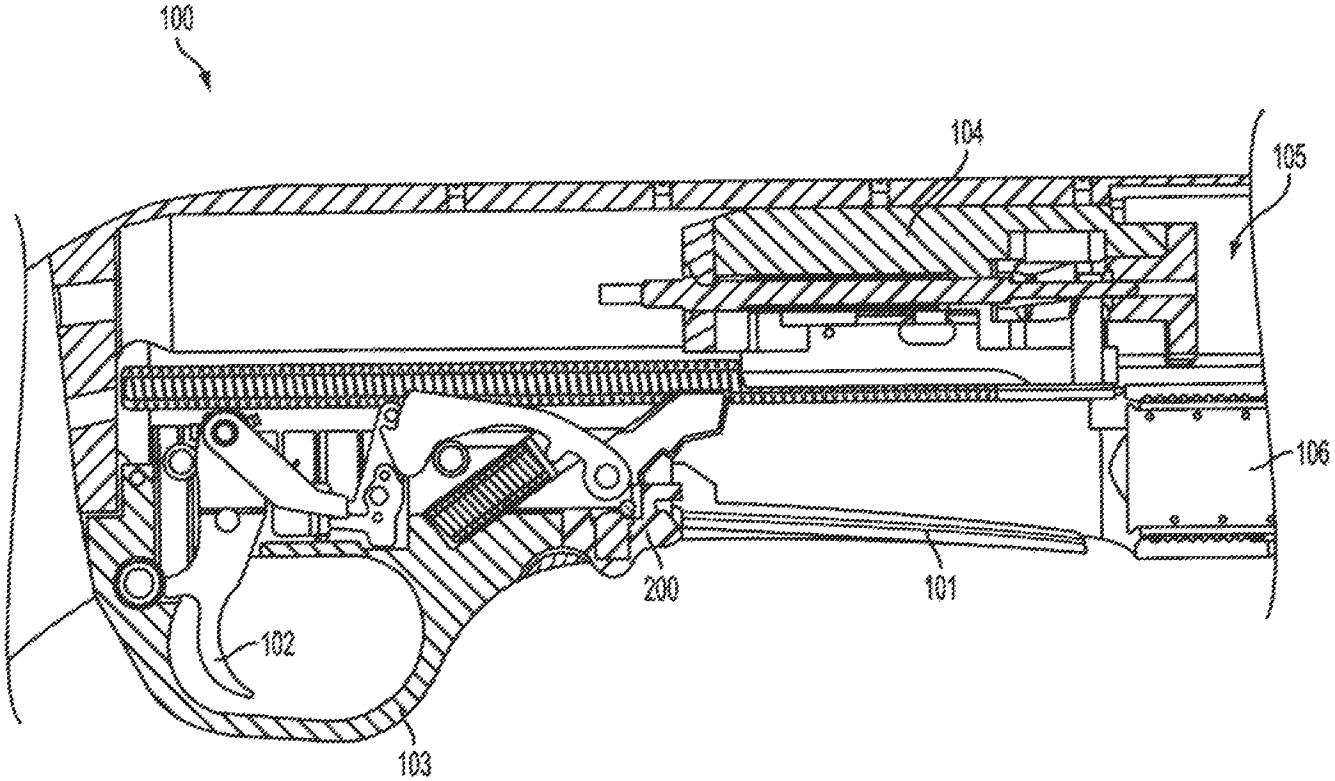
FIG. 1 shows a semi-automatic shotgun with a tube-type magazine, configured according to principles of the disclosure.

The aspects of the present disclosure and the various features and advantageous details thereof are explained more fully with reference to the non-limiting aspects and examples that are described and/or illustrated in the accompanying drawings and detailed in the following description. It should be noted that the features illustrated in the drawings are not necessarily drawn to scale, and features of one aspect may be employed with other aspects as the skilled artisan would recognize, even if not explicitly stated herein. Descriptions of well-known components and processing techniques may be omitted so as to not unnecessarily obscure the aspects of the present disclosure. The examples used herein are intended merely to facilitate an understanding of ways in which the present disclosure may be practiced and to further enable those of skill in the art to practice the aspects of the present disclosure. Accordingly, the examples and aspects herein should not be construed as limiting the scope of the present disclosure, which is defined solely by the appended claims and applicable law. Moreover, it is noted that like reference numerals represent similar parts throughout the several views of the drawings.

While the discussion herein is directed to shotguns and shotgun shells, a person skilled in the art will recognize that the principles of the present disclosure may be applied to any firearm that stores its ammunition, which may be of any type, in a tube-type magazine without departing from the spirit and scope of the disclosure.

The typical operation of an auto-loading shotgun or other firearm 100 with a tube-type magazine 106 may begin with the bolt 104 in the closed position and a shell (not shown) in the chamber 105, as seen in FIG. 1. The bolt 104 may be sent backward from the chamber 105 to the open position, e.g., by a force resulting from a discharge of a round in the weapon, actuation of a lever, or actuation of another mechanism (not shown). The shell in the chamber, or the casing if the gun was discharged, may be ejected through the ejection port (not shown) as the bolt 104 travels backward. At the rear of the bolt stroke, a carrier dog (e.g., 255 shown in FIGS. 7A-7D), which may be attached or connected to a carrier 101, may interact with a latch release 108, and the latch release 108 (shown in FIG. 4) may disengage a shell latch 107 (shown in FIG. 4). When the shell latch 107 is opened, one shell may be released from the magazine onto a carrier 101. One or more action springs (not shown) may move the bolt 104 forward from the rear of the bolt stroke. As the bolt 104 moves forward, the carrier 101 may rise and bring the shell (not shown) up to the bolt 104. The bolt 104 may engage the shell on the carrier 101 and push it into the chamber 105. The shotgun 100 may now be ready to be fired.

Figure 2:
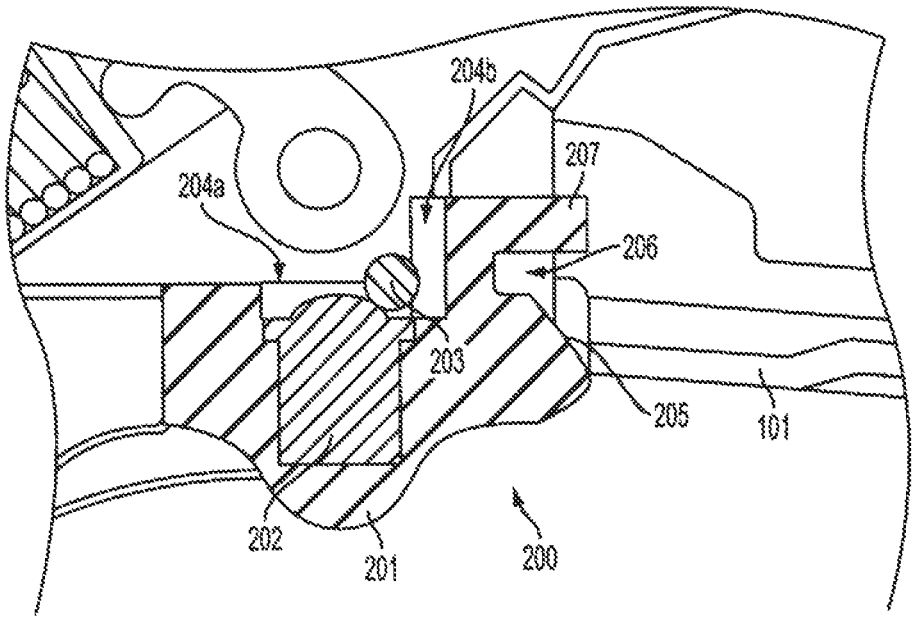
FIG. 2 shows a cutaway view of the shotgun with the cutoff in a disengaged position, configured according to principles of the disclosure.
Figure 3:
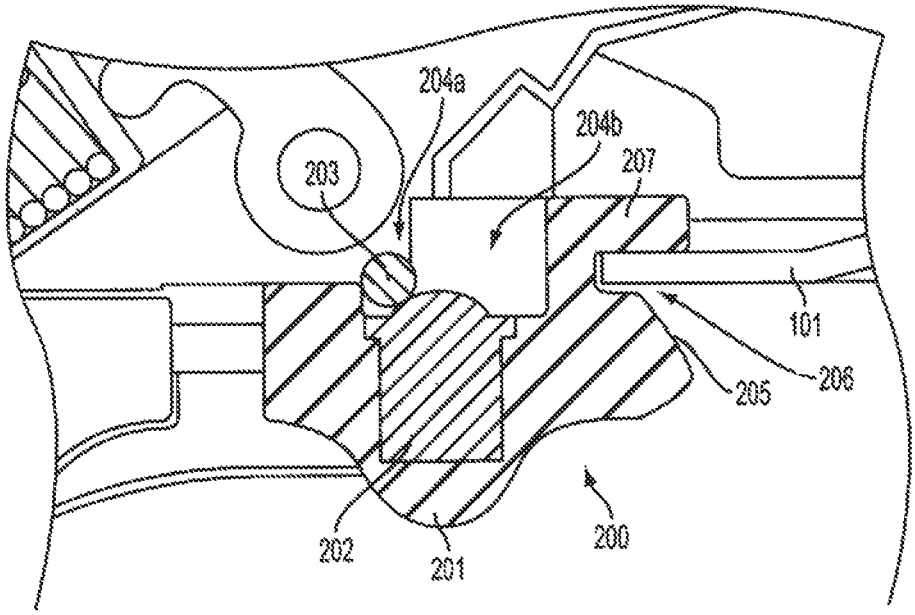
FIG. 3 shows a cutaway view of the shotgun with the cutoff in an engaged position, configured according to principles of the disclosure.

According to an aspect of the present disclosure, a shotgun or other firearm 100, such as, e.g., the one described above, may be provided with a magazine cutoff 200. FIG. 2 shows a cutaway view of the shotgun 100 with the cutoff 200 in a disengaged position, and FIG. 3 shows a cutaway view of the shotgun 100 with the cutoff 200 engaged. The cutoff may be positioned at the front of the trigger plate. In addition, the cutoff 200 may be located forward of the trigger 102 and trigger guard 103. The cutoff 200 may be centered left-to-right or it may be off-center, depending on the arrangement of related working parts of a particular firearm. The cutoff 200 may actuate or slide forward and backward in a direction that is substantially parallel to the firing direction or axis of the firearm and/or barrel.

The cutoff 200 may include a tab 201 so that it may be operated by right-handed or left-handed shooters with equal ease. For example, the tab 201 may have a curved surface and an equal or even thickness along a lateral axis, i.e. an axis that is perpendicular to the firing or aiming axis of the firearm and horizontal when the firing axis is horizontal. The tab 201 may be located or accessible on, e.g., the bottom of the firearm. Prior efforts to provide a user-selectable magazine feed control have used a tab or button located on either the right side or the left side. The tab or button in a firearm with this prior effort configuration may be more accessible to users of a given handedness and relatively inaccessible to shooters of the opposite handedness, which is a disadvantage of the prior efforts.

The cutoff 200 may include two or more notches 204*a*, 204*b* to hold the cutoff 200 in a corresponding number of positions. In addition, the cutoff 200 may have a plurality of positions, user selectable. The notches 204*a*, 204*b* may be separated by a column 202. The column 202 may include a domed top, and the column 202 may work with a bar 203 to keep the cutoff 200 in position. For example, the bar 203 may be fixed in position, relative to the other components of the firearm. With this arrangement, the column 202 may be constructed with an elastic material, e.g., a spring, so that it may be depressed by the bar 203 as the cutoff 200 transitions or actuates between positions. The column 202 may be depressed as a result of pressing against the bar 203 as the user slides the cutoff 200 from one position to another. Alternatively, the bar 203 may be spring-loaded, and it may travel up and down as the cutoff 200 shifts from one position to another.

The cutoff 200 may include a sloped portion 205 that is located on the front of the cutoff 200. The sloped portion 205 may lead up to a notch 206, and a retaining tab 207 may be located above the notch 206. As the cutoff 200 transitions from the inactive or disengaged position (seen, e.g., in FIG. 2) to the active or engaged position (shown, e.g., in FIG. 3), the sloped portion 205 may contact the edge of the carrier 101. As the cutoff 200 continues to move into the engaged position, the sloped portion 205 may guide and support the carrier 101 until it is seated within notch 206. When the cutoff 200 is in the engaged position, the carrier 101 may be prevented from moving further up by the retaining tab 207. Likewise, the carrier 101 may be prevented from moving down by the shape of the notch 206. Thus, when the cutoff 200 is engaged, the carrier 101 may be retained or locked in a position between its lowest position and its highest position.

Figure 4:
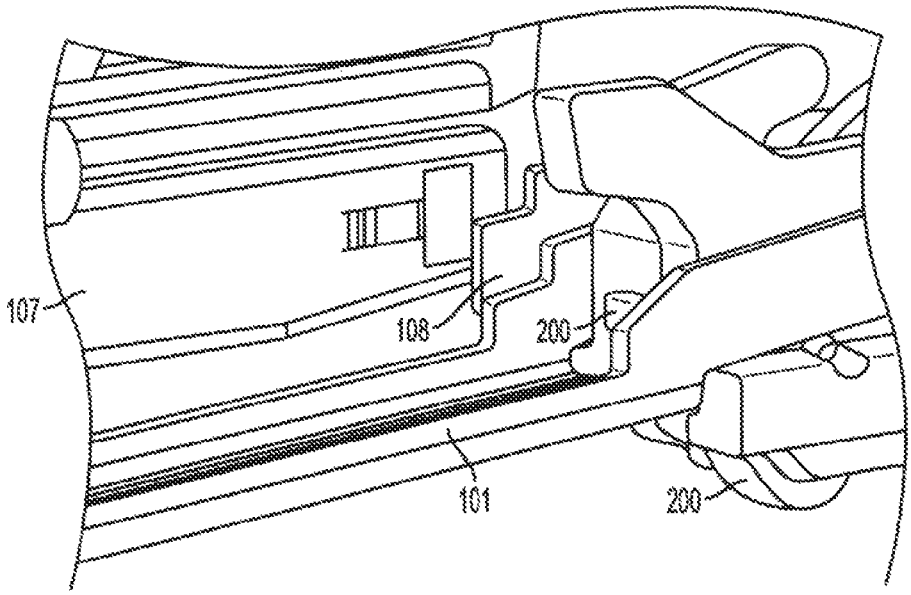
FIG. 4 shows a partial cutaway view of the carrier mechanism of the shotgun with the cutoff in a disengaged position, configured according to principles of the disclosure.

FIG. 4 shows a partial cutaway perspective view of the carrier mechanism of the shotgun 100 with the cutoff 200 disengaged. As discussed before, the latch release 108 may disengage the shell latch 107 when the bolt 104 is at the rear of the bolt stroke. The latch release 108 may move out of the way of the shell latch 107, for example, by rotating or sliding down. The movement of the latch release 108 may be a result of an interaction with a carrier dog (e.g., carrier dog 255 of FIGS. 7A-7D), which may be attached or connected to the carrier 101. When the latch release 108 is out of the way or otherwise no longer engaging the shell latch 107, the shell latch 107 may swing or rotate open. The motion of the latch 107 may be powered by, e.g., a spring, one or more gears, discharge gases, or the like.

The closing motion of the latch 107 may be driven by a shell exiting the magazine 106. The shell may be pushed out of the magazine 106, e.g., by a magazine spring (not shown). The forward movement of the bolt 104 may also cause the carrier 101 to lift or rise upward. The lifting of the carrier 101 may be powered by an interaction between the bolt 104 and the carrier 101, such as, e.g., a direct contact between the bolt 104 and the carrier 101, an intermediate component such as a carrier dog (e.g., 255 FIGS. 7A-7D), or the like.

Figure 5:
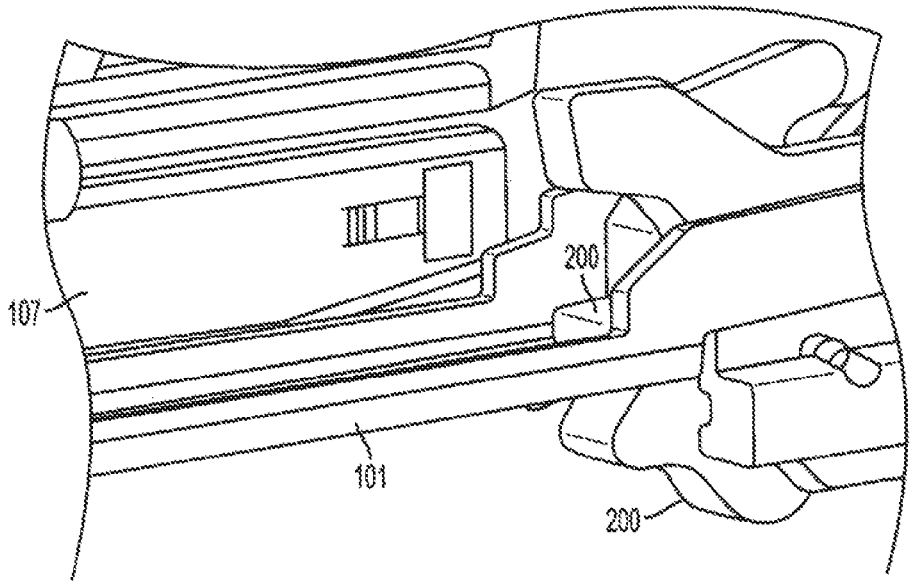
FIG. 5 shows a partial cutaway view of the carrier mechanism of the shotgun with the cutoff in an engaged position, configured according to principles of the disclosure.

FIG. 5 shows a partial cutaway view of the carrier mechanism of the shotgun 100 with the cutoff 200 engaged. The carrier 101 may be engaged by the notch 206 in the cutoff 200. As a result, the carrier 101 may be raised or lifted from its resting position (as seen, e.g., in FIG. 4). However, the retaining tab 207 on the cutoff 200 may prevent the carrier 101 from rising any farther. In this raised position, the carrier 101 may cover a portion of the shell latch 107.

When the user opens the bolt 104 with the cutoff 200 engaged, the carrier 101 may prevent the shell latch 107 from opening even when the release latch 108 is disengaged. When the bolt 104 moves forward from the end of the bolt stroke, it may interact with a mechanism to lift or raise the carrier 101. The mechanism may, for example, be a carrier dog (e.g., 255 FIGS. 7A-7D) or similar mechanism known to those skilled in the art. The carrier 101, however, may not be able to rise farther due to its interaction with the retaining tab 207 of the cutoff 200. Since the carrier 101 may be immobile, the carrier dog 255, or other mechanism, may instead cause the bolt 104 to be fixed or locked in an open position.

The cutoff 200 may function to lock the bolt 104 open without a shell in the chamber 105. In addition, any shells loaded into the magazine 106 are retained in the magazine 106. Making the gun safe for handling, e.g., for riding an ATV or crossing a fence, is now a simple procedure and does not require emptying the entire magazine.

In a typical scenario, for example, a hunter may need to cross a fence. The hunter's firearm may be a shotgun that contains one shell in the chamber and one or more shells in a tube-type magazine. The shotgun may also be equipped with a magazine cutoff according to the present disclosure. Before crossing the fence, the hunter may slide the cutoff 200 forward to an engaged position. The cutoff 200 may slightly lift the carrier 101 and may then hold the carrier 101 in this raised position. The hunter may pull an operating handle on the shotgun fully rearward, which may cause the firearm to eject the round in the chamber. In its raised position, the carrier 101 may prevent the shell latch from opening, thereby retaining any shells in the magazine. Because the carrier may be locked in position by the cutoff 100, the carrier may also prevent the bolt from moving forward from the rearward position. In addition to having the mechanical safety engaged, the firearm may now have the bolt locked open and no round in the chamber. It may be safe for the hunter to pass the firearm over or through the fence and place it on the other side.

The hunter may gather the ejected shell and cross the fence. Once across the fence, the hunter may manually insert the ejected shell back into the chamber. He may slide the cutoff from an engaged position to a disengaged position. Since the carrier may now be able to move freely, it no longer locks the bolt in an open position. The bolt may slide closed, and the shotgun may be ready for use again.

A variation on the above scenario may be used to quickly change the type of chambered ammunition without having to completely unload the magazine first. In this scenario, for example, a duck hunter may carry a shotgun loaded with a #2 shot. If a flock of geese approaches, the hunter may wish to change to a BB shot. The hunter may first engage the cutoff and pull the operating handle fully rearward. Instead of rechambering the ejected shell as in the first scenario, he/she may insert a shell of the new ammunition type. He may then deactivate or disengage the cutoff, which may make the firearm ready to fire the new ammunition. After firing the new ammunition type, the firearm may automatically chamber a shell of the original ammunition type from the magazine.

In addition, a magazine cutoff device may be used to ease or speed loading or unloading of a tube-type magazine. In a typical shotgun or other firearm with a tube-type magazine, a user may load shells one at a time by pressing each shell against the underside of the carrier and then sliding the shell into the magazine. To unload the magazine, the user may manually actuate the bolt to eject the shells, one at a time. In a shotgun or other firearm equipped with a magazine cutoff, the process may be much simpler. The user may simply raise the carrier, e.g., with a finger, and then slide the cutoff forward, which may lock the carrier in the raised position. To load the magazine, the user may simply slide the shells into the magazine. There may be no need to press against the carrier each time, as the carrier may be locked in a raised position, out of the way, by the cutoff. Similarly, shells may be unloaded from the magazine by locking the carrier in a raised position, as described above with regard to loading the magazine. With the carrier raised, shells may be easily removed from the magazine, e.g., by sliding each shell free of the magazine or by the force of one or more magazine springs.

Figure 6:
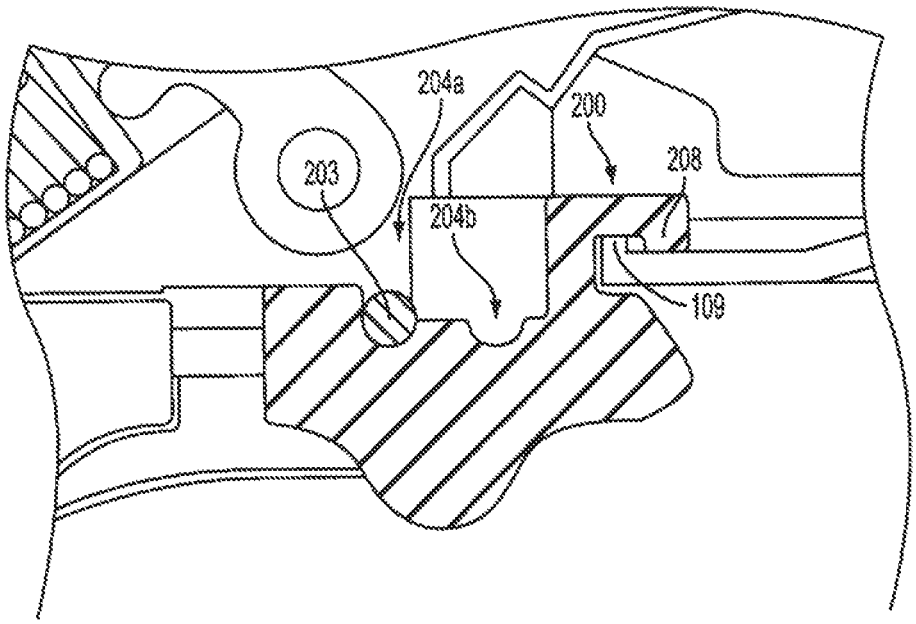
FIG. 6 shows a magazine cutoff configured according to an alternate aspect of the present disclosure.

FIG. 6 shows a magazine cutoff according to an alternate aspect of the present disclosure. The notches 204*a*, 204*b* may be located on the top of the cutoff 200 without a column 202 or similar apparatus disposed between them. In this aspect, the bar 203 may be spring-loaded so that it pops out of a notch 204*a*, 204*b* when the cutoff is transitioned to a different position. Alternatively, there may be release button, actuation lever, or similar mechanism located on the exterior of the firearm. Such a mechanism may physically remove the bar 203 from the notches 204*a*, 204*b* so that the cutoff may be transitioned to a different position.

The retaining tab 207 may include a lip 208. The lip 208 may be a square block, as shown in FIG. 6, or it may have rounded corners or sloping sides. The lip 208 may interface with a lip 109 on the carrier 101 to prevent the carrier cutoff device 200 from disengaging unintentionally. For example, if a mechanism of the firearm, such as, e.g., springs, discharge gases, or the like, is attempting to drive the carrier 101 upward, the interaction of lip 208 with lip 109 may prevent the cutoff 200 from disengaging. If no mechanism is acting on the carrier 101, or if a mechanism is attempting to lower the carrier 101, then there may be sufficient clearance for the lips 208, 109 to pass one another without interacting. If there is a slight vertical overlap between the lips 109, 208, a design that incorporates rounded corners, sloped or angled sides, or the like may permit the lips 109, 208 to pass one another despite some interaction.

Figure 7A:
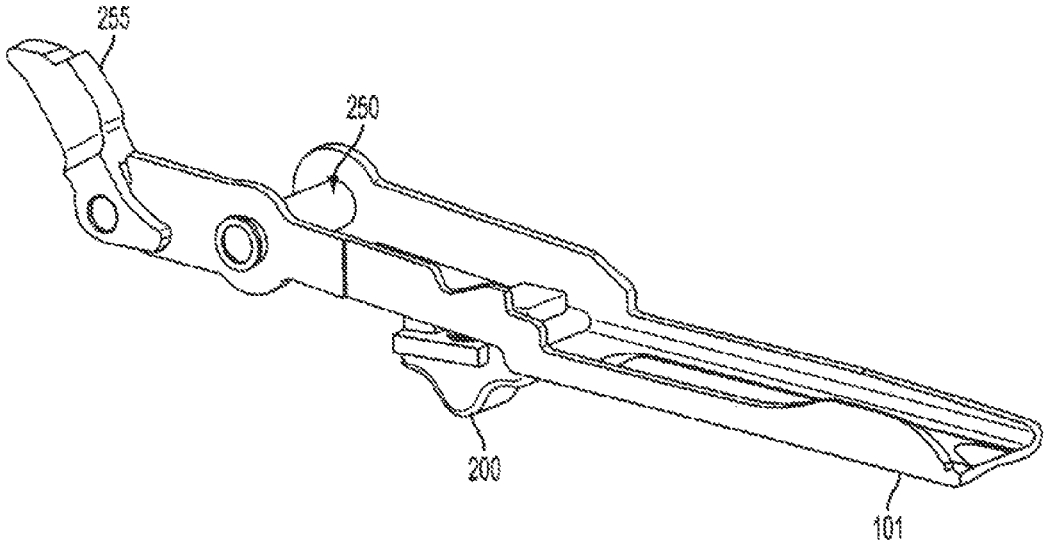
FIG. 7A shows an interaction between a carrier, carrier pivot tube and carrier dog, configured according to principles of the disclosure.

FIG. 7A shows an interaction between a carrier, carrier pivot tube, and carrier dog, configured according to principles of the disclosure. Generally, by raising the carrier 101, forward of the carrier pivot tube 250, the carrier dog 255 is lowered, which is further described in relation to FIG. 7C.

Figure 7B:
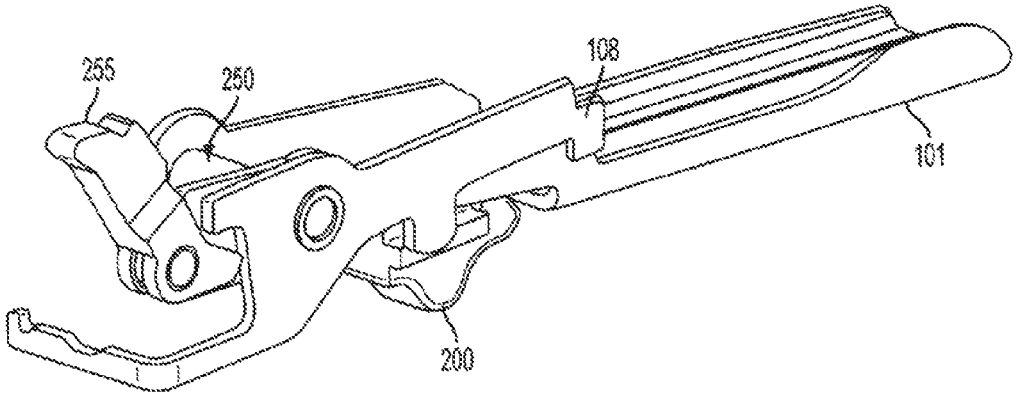
FIG. 7B shows an interaction of a latch release and the components of FIG. 7A, configured according to principles of the disclosure.

FIG. 7B shows an interaction of a latch release and the components of FIG. 7A, configured according to principles of the disclosure. The latch release 108 is shown configured mounted to the carrier pivot tube 250. The latch release may rotate independently of the other components of FIG. 7B.

Figure 7C:
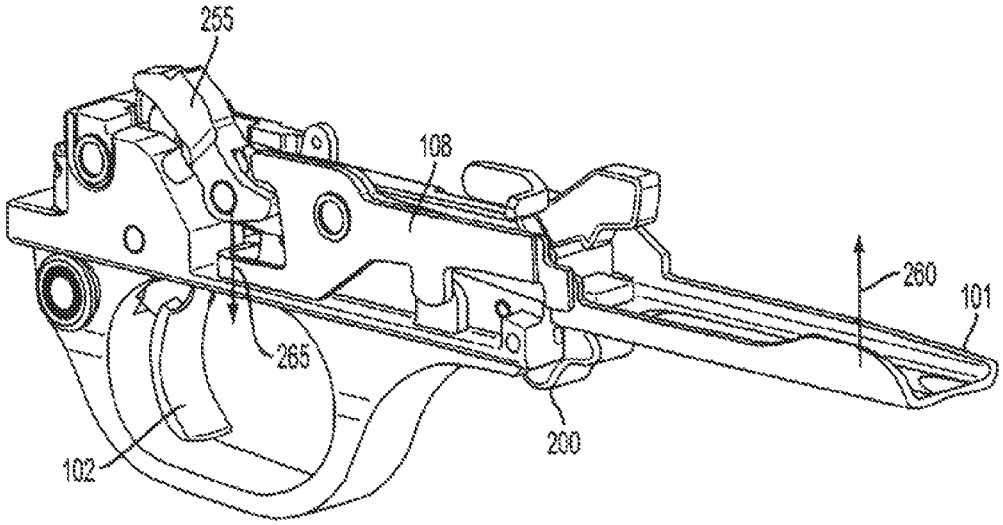
FIG. 7C shows an interaction of a latch release and the components of FIG. 7A, configured according to principles of the disclosure.
Figure 7D:
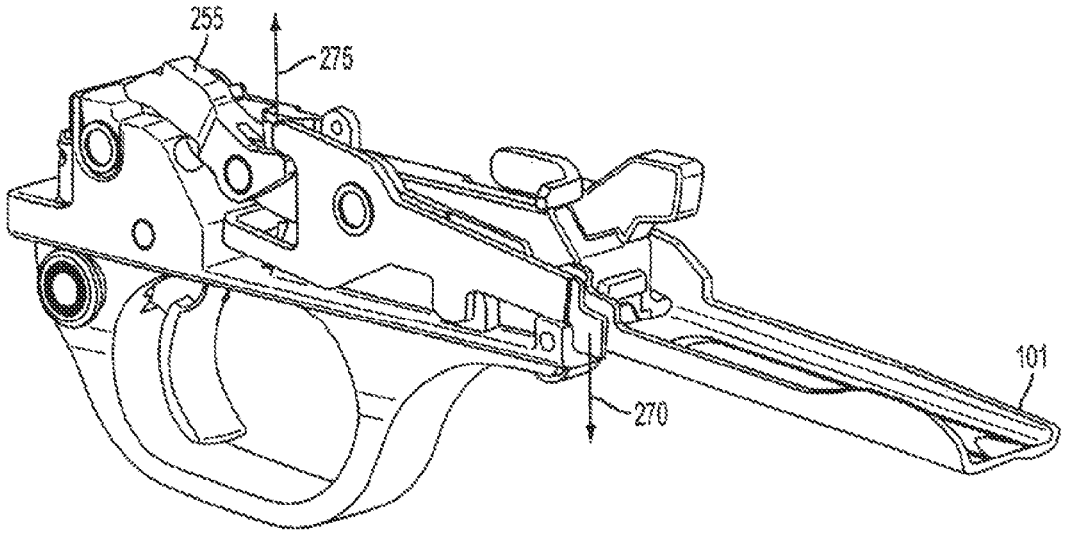

FIGS. 7C and 7D illustrates additional latch release functionality of FIG. 7B, configured according to principles of the disclosure. Both FIGS. 7C and 7D show the fire control in the bolt open position.

Referring to FIG. 7C, the magazine cutoff 200 has already been activated. In this mode, there is no contact between the carrier dog 255 and the latch release 108 due to the lowering (shown by arrow 265) of the carrier dog 255. This may be accomplished by lifting of the carrier 101 in front of its carrier pivot tube 250. Since the latch release 108 is not activated, the shell latch 107 retains ammunition in the magazine tube 106.

In FIG. 7D, the magazine cutoff 200 is not activated, or disengaged. Since the relative position of the carrier dog 255 and shell latch 107 are unaffected, the carrier dog lifts (shown by arrow 275) the latch release 108 at one end, while lowering (as shown by arrow 270) the opposite end, thereby permitting the shell latch 107 to rotate, which is the normal operating mode of the gun. In this way is latch release 108 may be operably connectable to the shell latch 107.

A magazine cutoff 200 according to the present disclosure may be made from any suitable material, including, for example, galvanized steel, heavy-gauge aluminum, plastic, ceramic, and the like. A magazine cutoff 200 may be manufactured by providing the necessary components, such as, e.g., a sloped portion 205, a notch 206, and/or a retaining tab 207. Additional components may include a tab 201, a column 202, and notches 204*a* and 204*b*. The components may be provided, for example, by providing a mold for the cutoff 200 that contains the desired features in a desired arrangement. The mold may be used, e.g., for casting a metal part or for injection-molding a plastic part. The specifics of the manufacturing process will vary depending on the desired features and materials used, and the specifics will be apparent to those skilled in the art of firearm design and manufacture.

A firearm 100 according to the present disclosure may be made from any suitable material or combination of materials, including, e.g., galvanized steel, heavy-gauge aluminum, plastic, ceramic, resin, wood, and the like. A firearm 100 may be manufactured by providing the necessary components, such as, e.g., a firing mechanism including a chamber 105, a tube-type magazine 106, a carrier 101, and a magazine cutoff device 200. The magazine cutoff device 200 may be structured and/or arranged to retain the carrier 101 in a position, thereby preventing the release of a shell from the magazine 106. The components may be provided, for example, by casting metal parts using a mold, injection-molding plastic parts using a mold, pultruding fiber reinforced polymer composite parts, machining parts, drilling and finishing wood parts, and the like. The specifics of the manufacturing process will vary depending on the desired features and materials used, and the specifics will be apparent to those skilled in the art of firearm design and manufacture.

While the present disclosure has been described in terms of exemplary aspects, those skilled in the art will recognize that the present disclosure can be practiced with modifications in the spirit and scope of the appended claims. These examples given above are merely illustrative and are not meant to be an exhaustive list of all possible designs, aspects, applications or modifications of the present disclosure.

What is claimed is:

1. A firearm comprising:

a tube-type magazine configured to hold at least one shell;

a bolt having an open position and a closed position;

a carrier configured to transfer a shell from the magazine to engage the bolt;

a shell latch proximate the carrier and configured to release a shell from the magazine onto the carrier; and a magazine cutoff device movable between a plurality of user selectable positions, including an engaged position configured to engage and retain the carrier in a predetermined position that substantially prevents the shell latch from releasing a shell from the magazine onto the carrier.

2. The firearm of claim 1, wherein the cutoff device comprises:

a body comprising a front, a top, and a bottom;

a sloped portion located on the front of the body; and a notch located adjacent to the sloped portion.

3. The firearm of claim 2, wherein the cutoff device further comprises a retaining tab located above the sloped portion on the front of the body.

4. The firearm of claim 2, wherein the notch is located between the sloped portion and the retaining tab.

5. The firearm of claim 2, wherein the cutoff device further comprises a tab located on the bottom of the body, the tab configured to be accessible by a user of the firearm to move the cutoff device between an engaged position and a disengaged position.

6. The firearm of claim 2, wherein the cutoff device further comprises:

at least two notches located on the top of the body, the at least two notches comprising a first notch and a second notch; and a column located between the first notch and the second notch.

7. The firearm of claim 6, wherein the column comprises a domed top.

8. The firearm of claim 2, wherein the notch is configured to engage the carrier when the cutoff device is in the engaged position.

9. The firearm of claim 8, wherein the carrier is configured to retain at least one shell in the magazine when the cutoff device is in the engaged position, and the carrier is further configured to releasably hold the bolt in an open position when the cutoff device is in the engaged position.

10. The firearm of claim 1, further comprising a carrier dog configured to selectively engage or disengage with a latch release, wherein the carrier dog engages with the latch release when the cutoff device is disengaged permitting loading of at least one shell from the magazine, and wherein the carrier dog disengages with the latch release when the cutoff device is engaged preventing loading of a shell from the magazine.

11. The firearm of claim 10, wherein the latch release is operably connectable to a shell latch to control loading of the at least one shell from the magazine.

* * * * *